US008784084B2

(12) United States Patent
Hwang et al.

(10) Patent No.: US 8,784,084 B2
(45) Date of Patent: Jul. 22, 2014

(54) ROTARY CAM RING FLUID MACHINE

(71) Applicants: RichStone Limited, Jeonbuk (KR); RichStone Limited, Tokyo (JP)

(72) Inventors: KwangSeon Hwang, Jeonju (KR); BooSeok Hwang, Tokyo (JP)

(73) Assignees: RichStone Limited, Jeonju (KR); RichStone Limited, Tokyo (JP)

( * ) Notice: Subject to any disclaimer, the term of this patent is extended or adjusted under 35 U.S.C. 154(b) by 123 days.

(21) Appl. No.: 13/684,498

(22) Filed: Nov. 24, 2012

(65) Prior Publication Data

US 2013/0183171 A1 Jul. 18, 2013

(30) Foreign Application Priority Data

Dec. 21, 2011 (JP) ..... 2011-280560

(51) Int. Cl.

| | |
|---|---|
| ***F04C 2/356*** | (2006.01) |
| ***F01C 1/00*** | (2006.01) |
| ***F01C 21/10*** | (2006.01) |
| ***F04C 15/00*** | (2006.01) |
| ***F04C 2/344*** | (2006.01) |
| ***F01C 21/08*** | (2006.01) |

(52) U.S. Cl.

CPC ..... *F04C 2/356* (2013.01); *F01C 21/106* (2013.01); *F04C 15/008* (2013.01); *F04C 2/3446* (2013.01); *F01C 21/0809* (2013.01)

USPC ..... 418/144; 418/263; 417/356

(58) Field of Classification Search

CPC .. F01C 21/0809; F01C 21/106; F04C 15/008; F04C 2/3446; F04C 2/356

USPC ..... 418/136, 139, 145–149, 160–161, 177, 418/259–260, 263, 140, 144; 417/456, 356

See application file for complete search history.

(56) References Cited

U.S. PATENT DOCUMENTS

| | | | | |
|---|---|---|---|---|
| 2,634,904 | A * | 4/1953 | Clerc | 418/96 |
| 2,937,599 | A * | 5/1960 | Rosaen | 417/440 |
| 3,359,914 | A * | 12/1967 | Adams et al. | 418/1 |
| 3,761,206 | A * | 9/1973 | Fierstine | 418/16 |
| 5,064,362 | A * | 11/1991 | Hansen | 418/186 |

FOREIGN PATENT DOCUMENTS

JP 2011-117391 A 6/2011

* cited by examiner

*Primary Examiner* — Hoang Nguyen

(57) ABSTRACT

A cam ring fluid machine, a rotary cam ring fluid machine has a casing, a flange in the casing, a stator in the casing, a rotor cam ring in the stator, a fixed axis in the rotor cam ring, and a vane in the vane groove of the fixed axis. A fluid chamber is formed with the inner circumferential surface of the rotor cam ring, the outer circumferential surface of the fixed axis, the vane, and the flange. When the rotor cam ring rotates, the volume of the fluid chamber increases or decreases.

9 Claims, 16 Drawing Sheets

ROTARY CAM RING FLUID MACHINE

CROSS-REFERENCE TO RELATED APPLICATIONS

This application claims priority to Japanese Patent Application JP2011-280560 filed Dec. 21, 2011 which application is incorporated by reference herein in its entirety.

STATEMENT REGARDING FEDERALLY SPONSORED RESEARCH OR DEVELOPMENT

Not Applicable

BACKGROUND

This disclosure relates to a fluid machine such as a liquid pump, a vacuum pump, a compressor, a blower, or an expander.

A vane pump has, for example a rotor, a cam ring, a vane, a supply port and an outlet port. The vane goes in and out a plurality of vane grooves radially formed in a rotor such that the vane has slide contact with the inner circumferential surface of the cam ring in response to the rotation of the rotor. The supply port supplies fluid to the pump space between the cam ring and the rotor and the outlet port permits the egress of the fluid. Such a vane pump becomes large in size because the vane pump is attached to a motor. Japanese Unexamined Patent Application Publication No. JP, 2011-117391, A (Jun. 16, 2011) discloses a small size vane pump. A stator is in a motor housing. A motor rotor is in the stator. A shaft rotates integrally with the motor rotor. A nonmagnetic pump rotor rotates integrally with the shaft and has a plurality of vane grooves on the circumferential surface thereof. A soft magnetic cam ring has an inner circumferential surface for accommodating the pump rotor. A soft magnetic vane is slidably accommodated in each vane groove so as to slide contact the inner circumferential surface of the cam ring. A soft magnetic pump housing accommodates the cam ring. The inner circumferential surface of the pump housing has contact with the outer circumferential surface of the cam ring. A part of the pump housing has contact with the stator. The volume of a plurality of pump chambers surrounded by the outer circumferential surface of the pump rotor, the inner circumferential surface of the cam ring and the vane is changed in accordance with the rotation of the pump rotor. The vane pump pulls the vane in accordance with magnetic action in a direction such that the vane gets out of the vane groove of the rotor. Although the size of the vane pump is reduced without a spring, the size cannot be sufficiently small because the pump section is configured separately from the motor section.

SUMMARY

A rotary cam ring fluid machine according to one aspect includes a casing, a flange which is fixed to the casing, a stator which is arranged in the casing, a rotor cam ring which is arranged in the stator and has an inner circumferential surface on the inner circumference thereof and a rotor on the outer circumference thereof, a fixed axis which has a vane groove opened to the outer circumferential surface thereof inside the rotor cam ring and has the flange at the end surface thereof and a vane which is accommodated in the vane groove of the fixed axis. A fluid chamber is formed with the inner circumferential surface of the rotor cam ring, the outer circumferential surface of the fixed axis and the vane and the flange. When the rotor cam ring rotates, the volume of the fluid chamber increases or decreases.

Other aspects and advantages will be apparent from the description and claims which follow.

BRIEF DESCRIPTION OF THE DRAWINGS

FIG. 2(*a*) is a perspective view. FIG. 2(*b*) is a side view. FIG. 2(*c*) is a cross-sectional view taken along the line A-A;

FIG. 4(*a*) is a perspective view. FIG. 4(*b*) is a side view. FIG. 4(*c*) is a front view;

FIG. 5(*a*) is a perspective view. FIG. 5(*b*) is a side view. FIG. 5(*c*) is a bottom view. FIG. 5(*d*) is a cross-sectional view taken along the line A-A;

FIG. 6(*a*) is a front view. FIG. 6(*b*) is a perspective view. FIG. 6(*c*) is a side view;

FIG. 7(*a*) is a front view. FIG. 7(*b*) is a perspective view. FIG. 7(*c*) is a side view;

FIG. 9(*a*) is an end view. FIG. 9(*b*) is a perspective view;

FIG. 10(*a*) is an end view. FIG. 10(*b*) is a perspective view;

FIG. 11(*a*) is an exploded view. FIG. 11(*b*) is a cross-sectional view;

FIG. 12(*a*) is a perspective view. FIG. 12(*b*) is an end view. FIG. 12(*c*) is a cross-sectional view taken along the line A-A;

FIG. 14(*a*) is a perspective view. FIG. 14(*b*) is an end view. FIG. 14(*c*) is a side view. FIG. 14(*d*) is a cross-sectional view taken along the line A-A;

FIG. 15(*a*) is a perspective view. FIG. 15(*b*) is a side view. FIG. 15(*c*) is a bottom view. FIG. 15(*d*) is a cross-sectional view taken along the line A-A;

FIG. 16(*a*) is a perspective view. FIG. 16(*b*) is a front view. FIG. 16(*c*) is a cross-sectional view taken along the line A-A;

FIG. 17(*a*) is a perspective view. FIG. 17(*b*) is a front view. FIG. 17(*c*) is a side view;

FIG. 19(*a*) is an axial sectional view. FIG. 19(*b*) is a cross-sectional view taken along the line A-A;

FIG. 22(*a*) is a cross-sectional view. FIG. 22(*b*) is a perspective view;

FIG. 23(*a*) is a cross-sectional view perpendicular to an axial direction. FIG. 23(*b*) is a cross-sectional view in an axial direction;

FIG. 24(*a*) is a cross-sectional view in an axial direction. FIG. 24(*b*) is an exploded view;

FIG. 26(*a*) is a cross-sectional view in an axial direction. FIG. 26(*b*) is a cross-sectional view taken along the line A-A. FIG. 26(*c*) is a cross-sectional view taken along the line B-B;

FIG. 27(*a*) is a cross-sectional view in an axial direction. FIG. 27(*b*) is a cross-sectional view taken along the line A-A.

DETAILED DESCRIPTION

Figure 1:
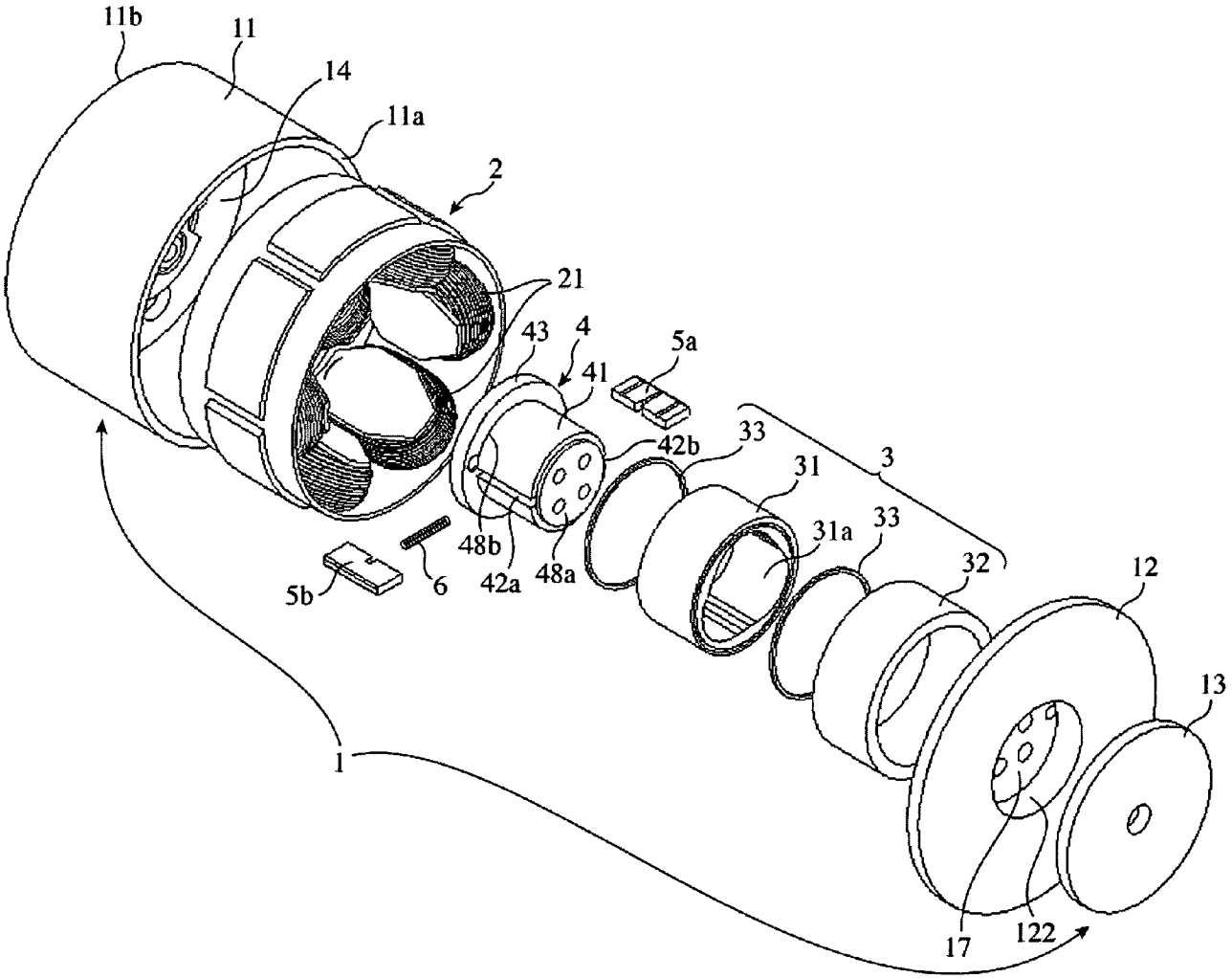
FIG. 1 is an exploded view of the machine according to a first embodiment.
Figure 18:
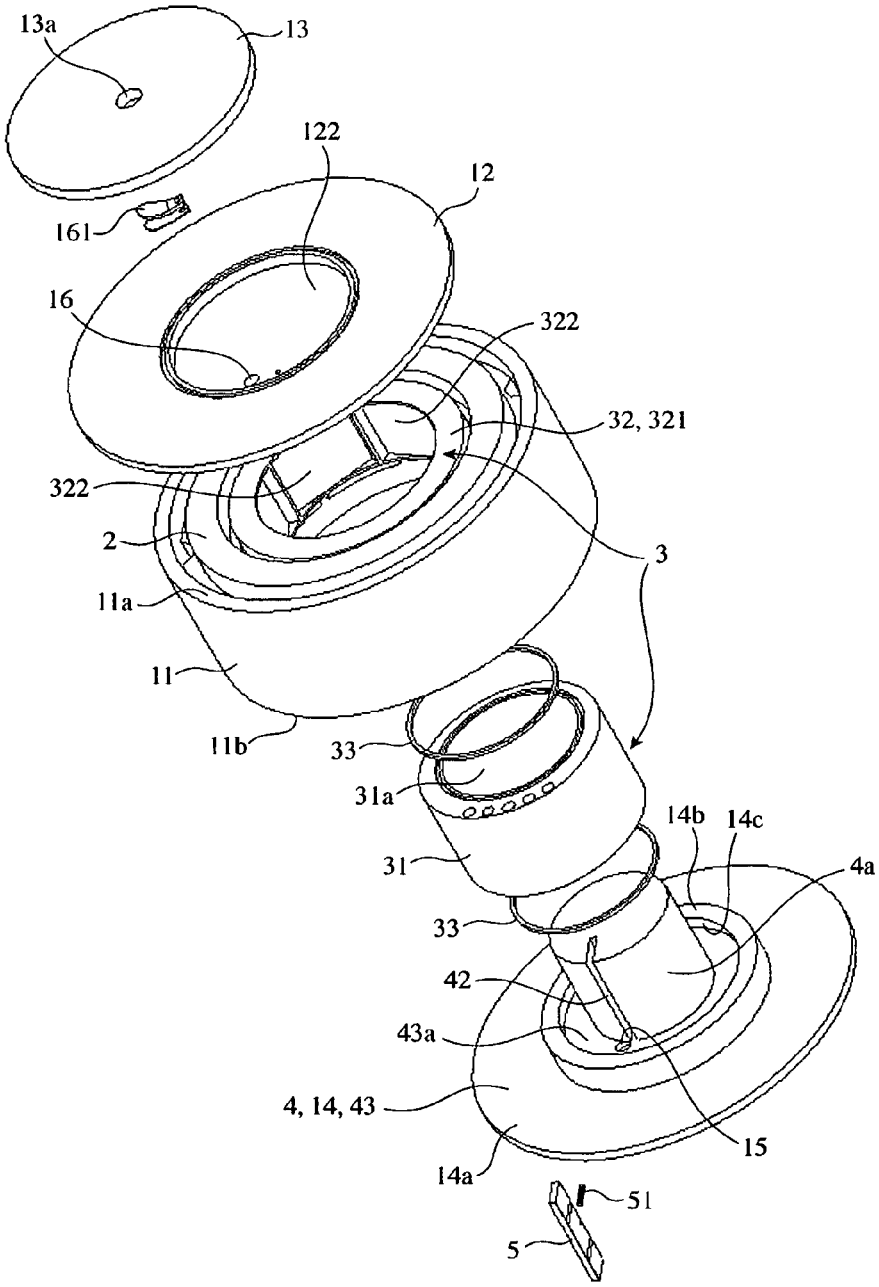
FIG. 18 is an exploded view of the machine according to a third embodiment.
Figure 22:
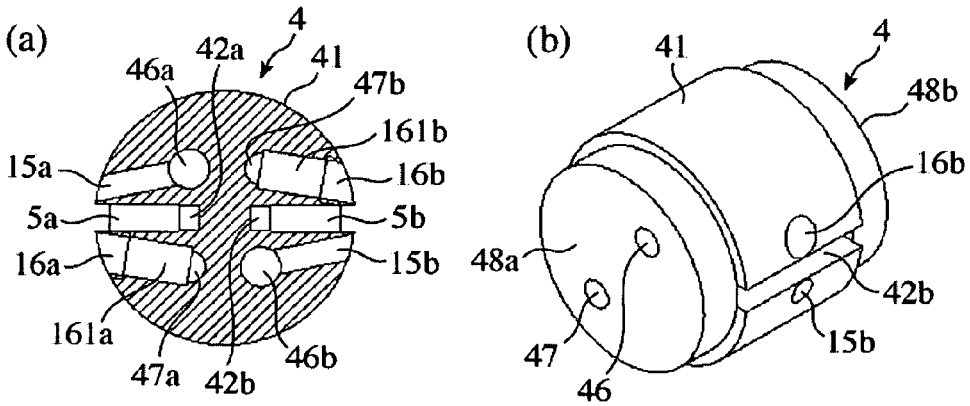
FIG. 22 shows a fixed axis according to a fifth embodiment.

FIGS. 1 to 8 show an example embodiment 1. FIG. 1 shows the machine. A casing 1 has a casing body 11, an outlet cover 13 and an inlet cover 14. A first flange 12 also constitutes the casing 1. The first flange 12 and a second flange 43 are fixed to the casing 1. A stator 2 having a plurality of coils 21 is arranged in the casing 1. A rotor cam ring 3 is coaxially and rotatably arranged in the stator 2 and has an inner circumferential surface 31*a* on the inner circumferential surface and a rotor 32 on the outer circumferential surface. The rotor cam ring 3 shown in FIG. 1 is comprised of a cam ring 31 having an inner circumferential surface 31*a* and the rotor 32 fixed to the outer circumferential surface of the cam ring 31. With reference to FIG. 18, the rotor cam ring 3 is configured integrally with the rotor 32 and the cam ring 31, the rotor 32 having the cam ring 31 fitted in the inner circumferential surface of a magnetic body ring 321 (rotor 32) into which a magnet 322 is incorporated. A fixed axis 4 has at least one axial vane grooves 42*a*, 42*b* open to an outer circumferential surface 41 inside the rotor cam ring 3, and has a first flange 12 and a second flange 43 provided on both end surfaces 48*a*, 48*b*. The first flange 12 is joined to one end 48*a* of the fixed axis 4 and one end 11*a* of the casing body 11. The second flange 43 is integrally formed with the other end 48*b* of the fixed axis 4. With reference to FIG. 22, the fixed axis 4 is not integrally formed with the flange, instead one end 48*a* of the fixed axis 4 and the first flange 12 are joined, and the other end 48*b* of the fixed axis 4 and the second flange 43 are joined. Vanes 5*a*, 5*b* are radially and slidably accommodated in the vane grooves 42*a*, 42*b* of the fixed axis 4. A fluid chamber 35 is formed with an inner circumferential surface 31*a* of the rotor cam ring 3 or the cam ring 31, an outer circumferential surface 41 of the fixed axis 4, the vanes 5*a*, 5*b* and the flanges 12, 43. When the rotor cam ring 3 rotates, the volume of the fluid chamber 35 increases or decreases.

Figure 2:
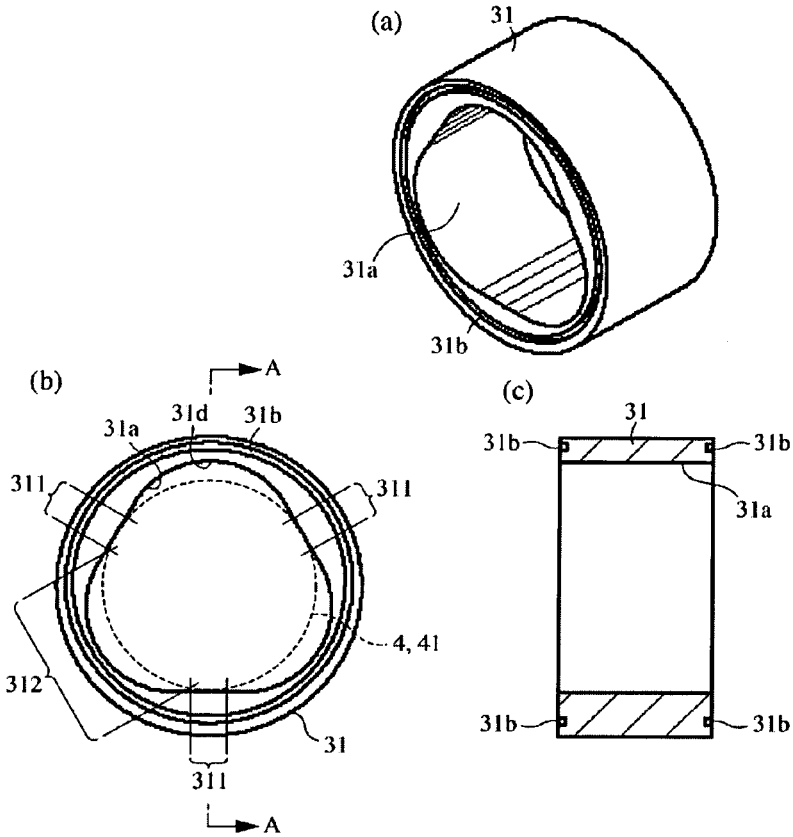
FIG. 2 shows a cam ring according to the first embodiment.
Figure 3:
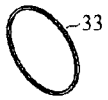
FIG. 3 is a perspective view of a round ring seal according to the first embodiment.

The cam ring 31 shown in FIG. 2 has a circular outer circumferential surface and a smoothly curved inner circumferential surface 31*a*. For example, a cam surface 31*d* is a portion of the inner circumferential surface 31*a*, which is in an arc-like recessed portion 312. The rotor cam ring 3 or the cam ring 31 has round ring seal grooves 31*b*, 31*b* at both end surfaces, which round ring seals 33, 33 shown in FIG. 3 are fitted into. The round ring seal groove 31*b* may be provided on the first flange 12 and the second flange 43. The round ring seal grooves 31*b*, 31*b* are eccentrically arranged with respect to the axis center of the rotor cam ring 3 or the cam ring 31. Both ends of the rotor cam ring 3 or the cam ring 31 has slide contact with the first flange 12 and the second flange 43 in a sealed state via the round ring seal 33. The inner circumferential surface 31*a* has three arc-like slide contact surfaces 311 having slide contact in a plane with the outer circumferential surface 41 of the fixed axis 4 and three arc-like recessed portions 312 between each of the arc-like slide contact surfaces 311. An annular rotor 32 is fixed to the outer circumferential surface of the cam ring 31.

Figure 4:
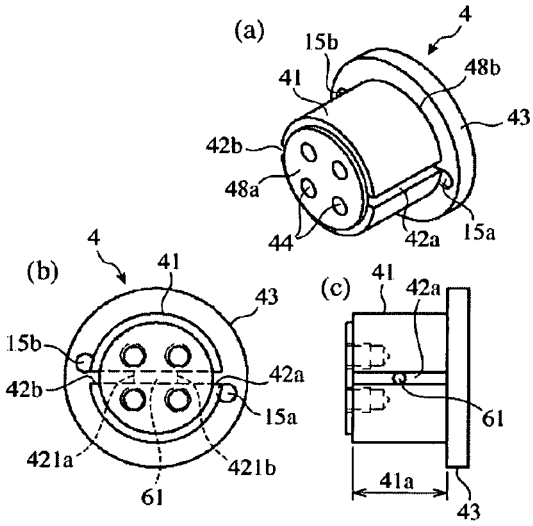
FIG. 4 shows a fixed axis according to the first embodiment.

The fixed axis 4 shown in FIG. 4 is provided with an outer circumferential surface 41, vane grooves 42*a*, 42*b*, the second flange 43 and a plurality of screw holes 44. The vane grooves 42*a*, 42*b* are axially opened to the outer circumferential surface 41. The other end 48*b* of the fixed axis 4 is integrally formed with the second flange 43. One end 48*a* of the fixed axis is joined with the first flange 12. The screw hole 44 passes through the fixed axis 4. Inlets 15*a*, 15*b* for fluid are provided on the second flange 43 adjacently to the vane grooves 42*a*, 42*b*.

Figure 5:
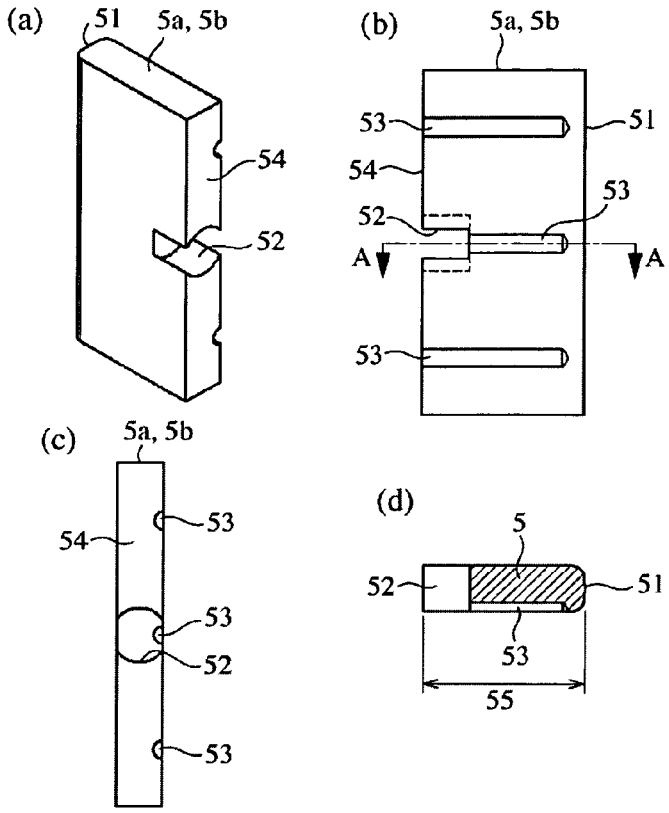
FIG. 5 shows a vane according to the first embodiment.

The length of the vane grooves 42*a*, 42*b* is substantially the same as the entire length 41*a* of the outer circumferential surface 41, and the depth thereof is larger than the width 55 of the vanes 5*a*, 5*b* shown in FIG. 5. A spring hole 61 is in the bottom portion of the vane grooves 42*a*, 42*b* and communicates with the vane grooves 42*a*, 42*b*. A spring 6 shown in FIG. 1 presses outward the vanes 5*a*, 5*b* shown in FIG. 5.

The vanes 5*a*, 5*b* shown in FIG. 5 have a tip surface 51, a spring groove 52, and at least one groove (back pressure groove) 53. The tip surface 51 has an arc-like cross-section and has slide contact with the inner circumferential surface 31*a* of the cam ring 31. The spring groove 52 is located to communicate with the spring hole 61 of the vane grooves 42*a*, 42*b* of the fixed axis 4 in the center of the bottom portion 54 of the vane 5. The spring groove 52 fixes a spring 6. The back pressure groove 53 is provided on one side surface of the vanes 5*a*, 5*b*. Each back pressure groove 53 extends from a position a little bit below the tip surface 51 to the bottom portion 54. The back pressure groove 53 works to substantially equalize the pressure of the vane groove 42 and the pressure of the fluid chamber 35. The pressure of the vane groove 42 is the pressure in the space between the bottom portion 54 of the vanes 5*a*, 5*b* and the bottom portions 421*a*, 421*b* of the vane grooves 42*a*, 42*b*. The spring 6 is fixed to the spring groove 52.

Figure 6:
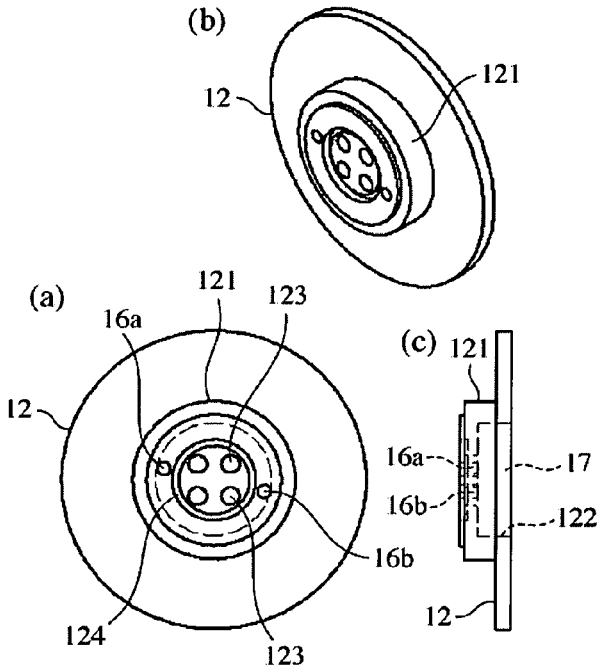
FIG. 6 shows a first flange according to the first embodiment.
Figure 19:
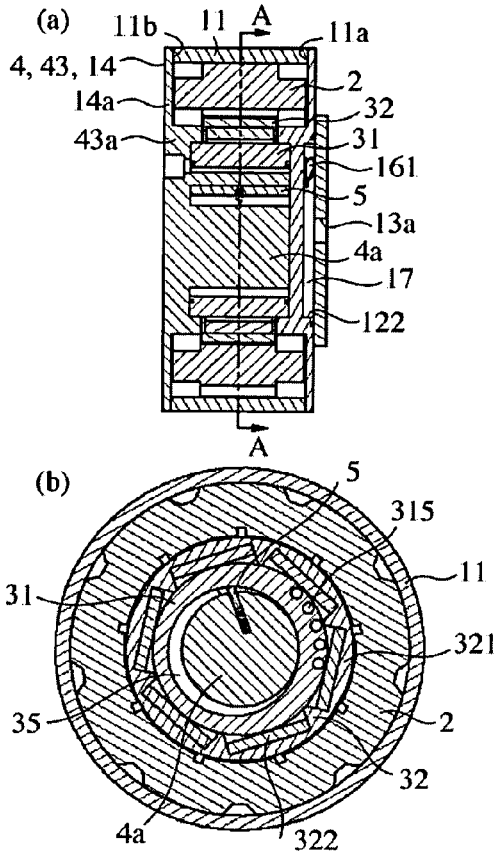
FIG. 19 shows a machine according to the third embodiment.

The first flange 12 shown in FIG. 6 is hermetically joined to one end 48*a* of the fixed axis 4 and one end 11*a* of the casing body 11. The first flange 12 joined to the one end 11*a* constitutes a part of the casing 1. The first flange 12 has an annular fluid chamber wall 121 on the inner surface thereof and has a storage portion 122 at the outside of the fluid chamber wall 121. The fluid chamber wall 121 has two outlets 16*a*, 16*b* and a plurality of screw holes 123. An O-ring groove 124 into which an O-ring is fitted is arranged around the screw hole 123. A storage portion 122 forms a storeroom 17 as shown in FIG. 19 by joining the first flange 12 and the outlet cover 13. The pulsating flows of the fluid output from the outlets 16*a*, 16*b* are rectified by the storeroom 17.

Figure 7:
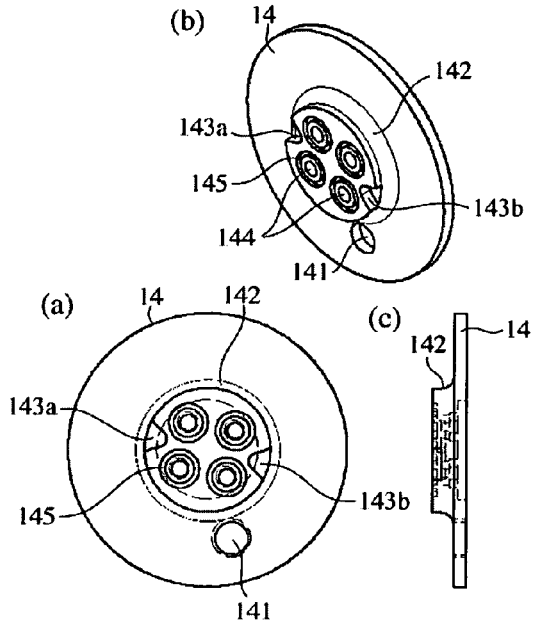
FIG. 7 shows an inlet cover according to the first embodiment.

The inlet cover 14 shown in FIG. 7 is hermetically joined to the other end 11*b* of the casing body 11. The inlet cover 14 has an inlet 141 of fluid and an annular fluid chamber wall 142 on the inner surface thereof. Intermediate inlets 143*a*, 143*b* are provided on the fluid chamber wall 142. The fluid chamber wall 142 hermetically comes into contact with the second flange 43 of the fixed axis 4, and the intermediate inlets 143*a*, 143*b* communicate with the inlets 15*a*, 15*b* of the second flange 43. The fluid coming through the inlet 141 of the inlet cover 14 passes through the intermediate inlets 143*a*, 143*b* and the inlets 15*a*, 15*b*, and enters into a fluid chamber 35 between the inner circumferential surface 31*a* of the cam ring 31 and the outer circumferential surface 41 of the fixed axis 4. The fluid chamber wall 142 has a plurality of the screw holes 144 and O-ring grooves 145.

Figure 8:
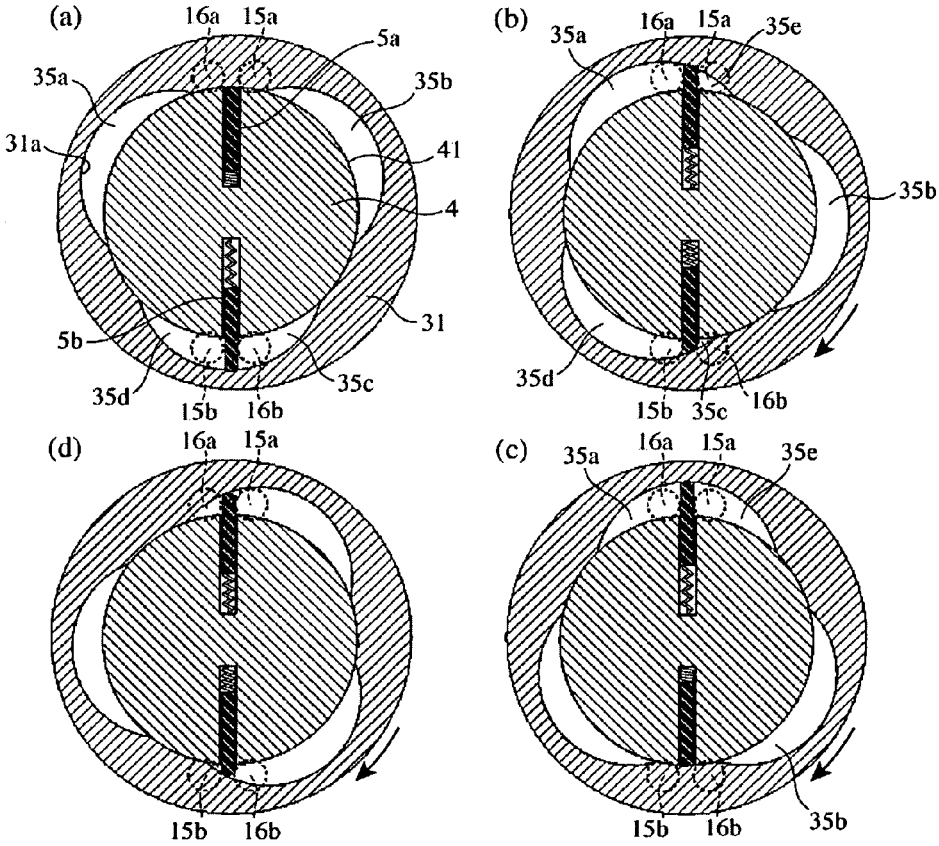
FIG. 8 is a cross-sectional view showing a principle of the increase or decrease in volume of the fluid chamber according to the first embodiment.

FIG. 8 shows a principle of the increase or decrease in volume of the fluid chamber 35 when the rotor cam ring 3 rotates. The number of the vanes is two (that is, smaller by one than the number of the arc-like recessed portions which is three), and thus the outlet amount or the inlet amount of the fluid becomes substantially constant when the rotor cam ring 3 rotates, whereby the torque fluctuation of the motor and the pulsatory motion of the fluid at the time of the outlet and inlet are suppressed. In FIG. 8(*a*) the vane 5*a* is positioned where the inner circumferential surface 31*a* of the cam ring 31 has contact with the outer circumferential surface 41 of the fixed axis 4, and the vane 5*b* is positioned where the inner circumferential surface 31*a* is the most away from the outer circumferential surface 41. The inlet 15*a* and the outlet 16*a* located at both sides of the vane 5*a* do not communicate with the fluid chamber between the inner circumferential surface 31*a* and the outer circumferential surface 41. The inlet 15*b* and the outlet 16*b* located at both sides of the vane 5*b* communicate with the fluid chambers 35*c*, 35*d* between the inner circumferential surface 31*a*, the outer circumferential surface 41 and the vane 5*b*. When the cam ring 31 rotates clockwise from FIG. 8(*a*) to FIG. 8(*b*), the fluid chamber 35*e* on the side of the inlet 15*a* expands to let in fluid through the inlet 15*a* into the fluid chamber 35*e*, while the fluid chamber 35*a* on the side of outlet 16*a* diminishes to let out fluid from the fluid chamber 35*a* through the outlet 16*a*. In FIG. 8(*c*), the vane 5*a* is in a position where the inner circumferential surface 31*a* is the furthest away from the outer circumferential surface 41, and the vane 5*b* is in a position where the inner circumferential surface 31*a* has contact with the outer circumferential surface 41. The inlet 15*a* and the outlet 16*a* on both sides of the vane 5*a* communicate with the fluid chambers 35*e*, 35*a* and the inlet 15*b* and the outlet 16*b* on both sides of the vane 5*b* do not communicate with the fluid chamber 35. When the cam ring 31 further rotates, the cam ring 31 returns to the state of FIG. 8(*a*) through the state of FIG. 8(*d*). As such, when the cab ring 31 rotates, the phase is shifted such that fluid is let in through the inlets 15*a*, 15*b* into the fluid chamber 35 and fluid is let out through the outlet 16*a*, 16*b* from the fluid chamber 35.

Figure 9:
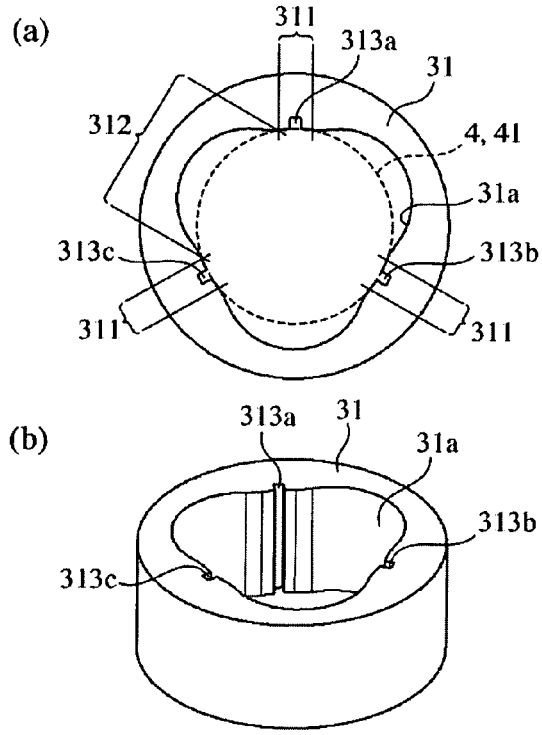
FIG. 9 shows another example of the cam ring.
Figure 10:
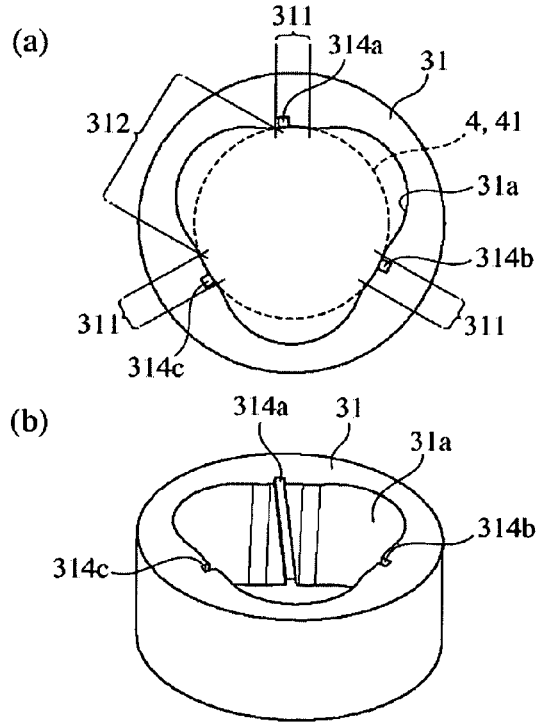
FIG. 10 shows still another example of the cam ring.

FIG. 9 shows another example of the cam ring 31. The three arc-like slide contact surfaces 311 in the inner circumferential surface 31*a* have slide contact in a plane with the outer circumferential surface 41 of the fixed axis 4. Seal grooves 313*a*, 313*b*, 313*c* are provided on the central portion of the arc-like slide contact surfaces 311, into which tip seals are inserted. FIG. 10 shows still another example of the cam ring 31. Tip seal grooves 314*a*, 314*b*, 314*c* are provided on the central portion of the arc-like slide contact surfaces 311. The tip seal grooves 314*a*, 314*b*, 314*c* into which the tip seals are inserted are a little bit tilted with respect to the axial direction. Since each tip seal is tilted, the impact of the vanes 5*a*, 5*b* coming into contact with the tip seals is mitigated.

Figure 11:
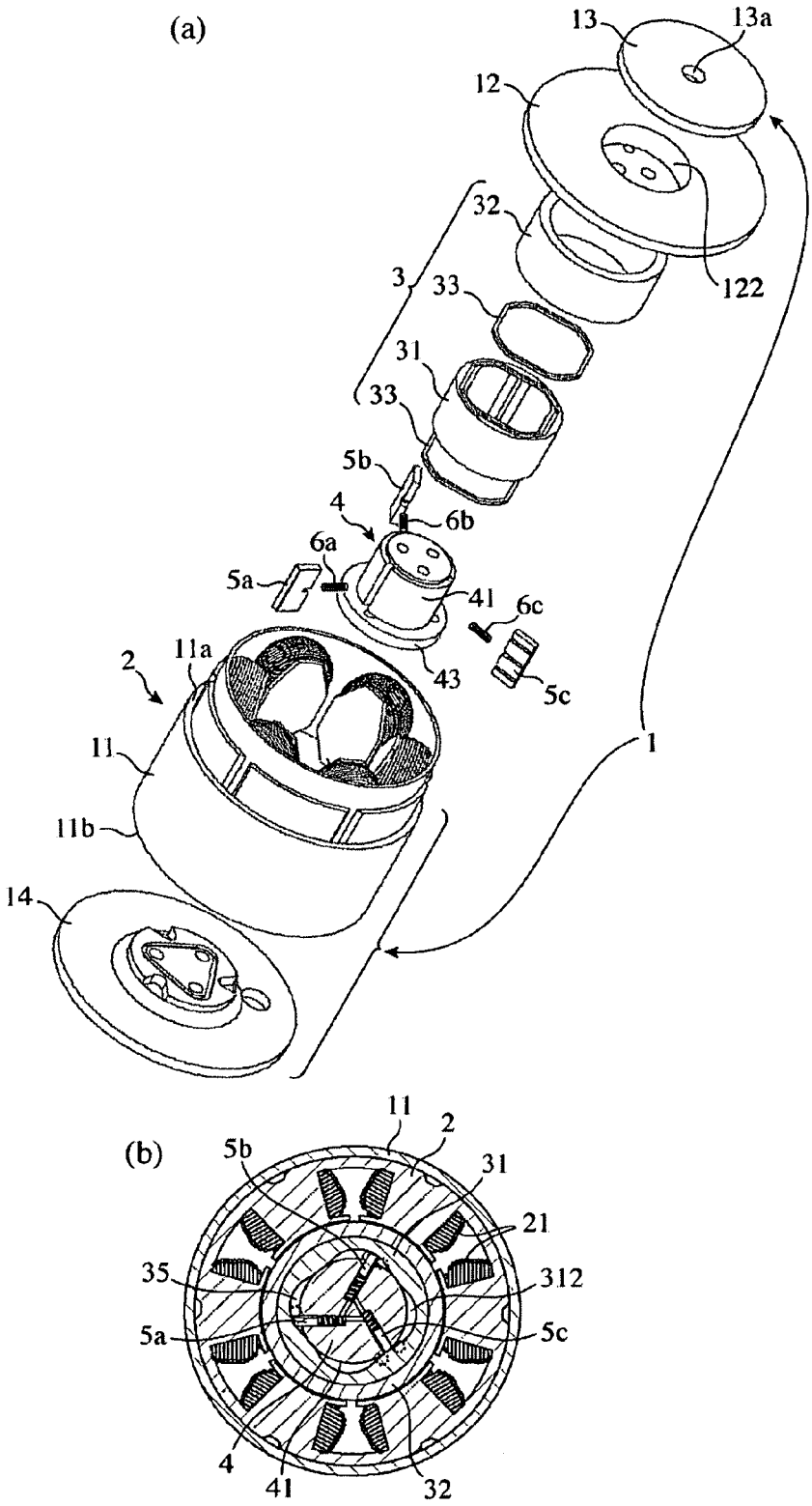
FIG. 11 shows the machine according to a second embodiment.
Figure 12:
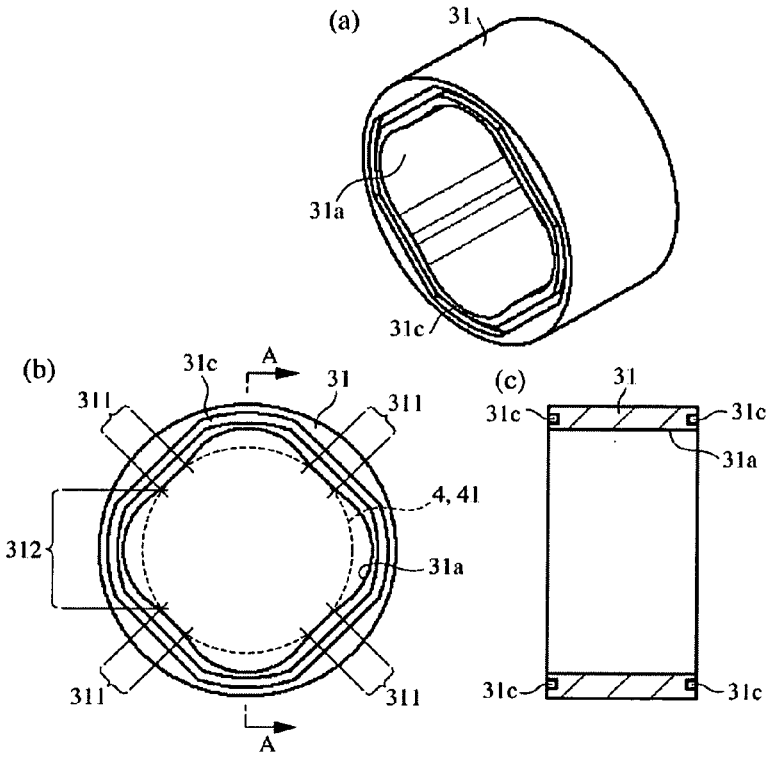
FIG. 12 shows a cam ring according to the second embodiment.
Figure 13:
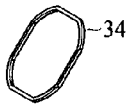
FIG. 13 is a perspective view of a square ring seal according to the second embodiment.
Figure 14:
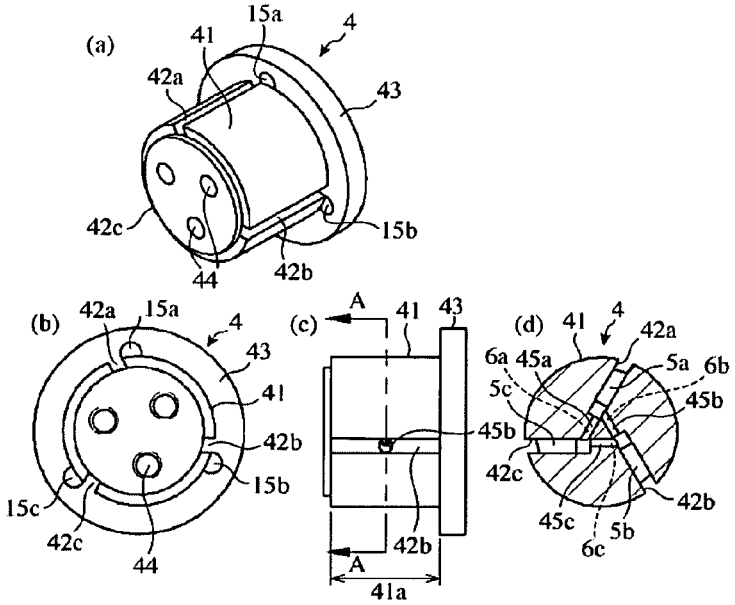
FIG. 14 shows a fixed axis according to the second embodiment.
Figure 15:
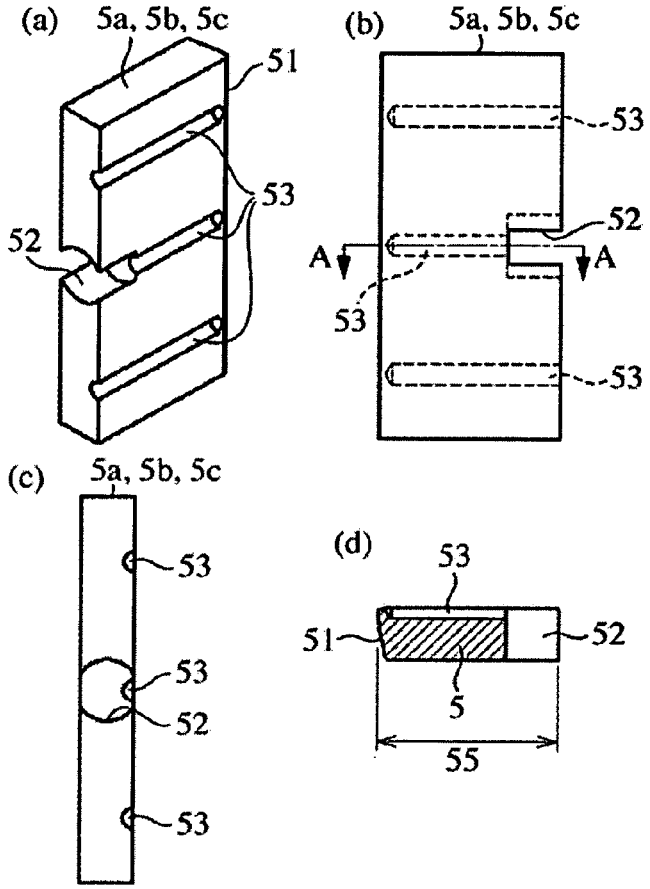
FIG. 15 shows a vane according to the second embodiment.
Figure 16:
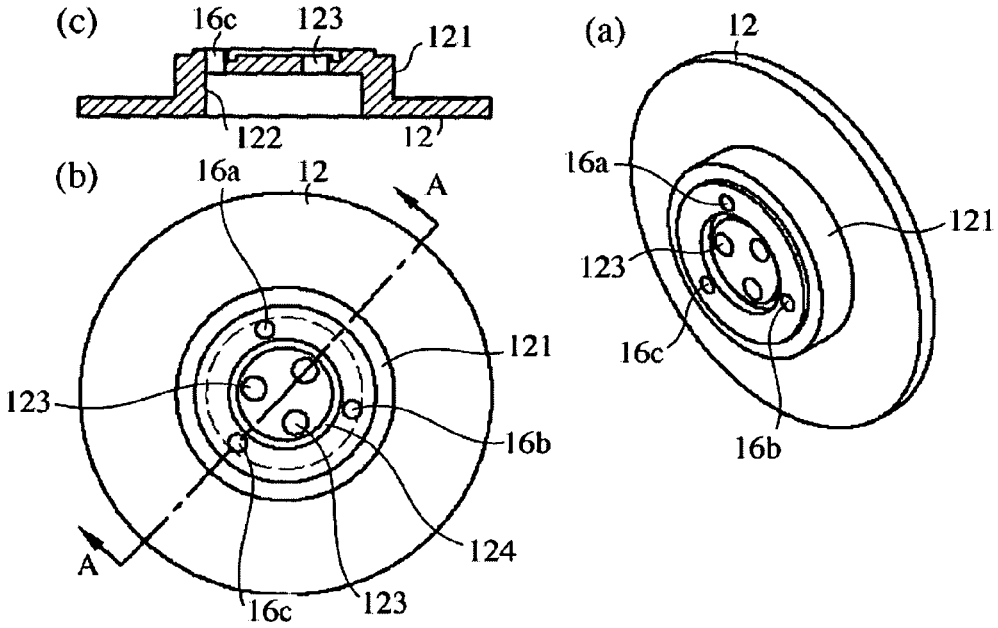
FIG. 16 shows a first flange according to the second embodiment.
Figure 17:
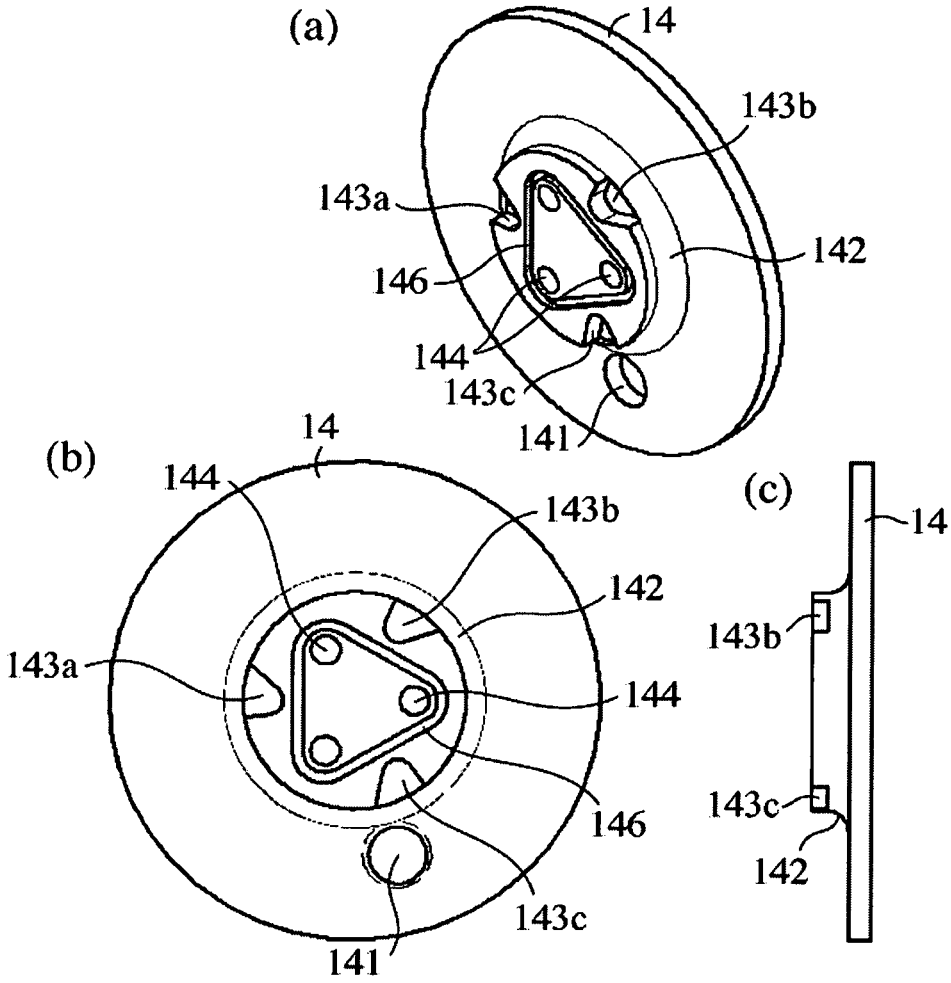
FIG. 17 shows an inlet cover according to the second embodiment.

FIG. 11 shows a different example of the machine in which the number of vanes 5 is three (that is, smaller by one than the number of the arc-like recessed portions 312 which is four). The inner circumferential surface 31*a* of the cam ring 31 shown in FIG. 12 has four arc-like slide contact surfaces 311 that have slide contact in a plane with the outer circumferential surface 41 of the fixed axis 4 and four arc-like recessed portions 312 between each arc-like slide contact surface 311. A square ring seal 34 shown in FIG. 13 and the square ring seal grooves 31*c*, 31*c* arranged on the end face of the cam ring 31 are not annularly shaped, and thereby the thickness of the cam ring 31 can be reduced. The fixed axis 4 shown in FIG. 14 has three vane grooves 42*a*, 42*b*, 42*c* opened to the outer circumferential surface 41. The second flange 43 has inlets 15*a*, 15*b*, 15*c* of the fluid adjacently to the vane grooves 42*a*, 42*b*, 42*c*. The length of the vane grooves 42*a*, 42*b*, 42*c* is substantially the same as the entire length 41*a* of the outer circumferential surface 41, and the depth thereof is larger than the width 55 of the vanes 5*a*, 5*b*, 5*c* shown in FIG. 15. Through-holes 45*a*, 45*b*, 45*c* are formed in the bottom portion of the vane grooves 42*a*, 42*b*, 42*c* of the fixed axis 4 and communicate with the vane grooves. Springs 6*a*, 6*b*, 6*c* are accommodated in the through-holes 45*a*, 45*b*, 45*c*. A fluid chamber wall 121 of the first flange 12 shown in FIG. 16 has three outlets 16*a*, 16*b*, 16*c*. An inlet cover 14 shown in FIG. 17 is hermetically joined to the other end 11*b* of the casing body 11. A fluid chamber wall 142 of the inlet cover 14 has intermediate inlets 143*a*, 143*b*, 143*c*. When the second flange 43 of the fixed axis 4 comes into contact with the fluid chamber wall 142, the intermediate inlets 143*a*, 143*b*, 143*c* communicate with the inlets 15*a*, 15*b*, 15*c* of the second flange 43. The fluid chamber wall 142 has a triangular O-ring groove 146 in the periphery of a plurality of screw holes 144, into which the O-ring is fitted.

Figure 20:
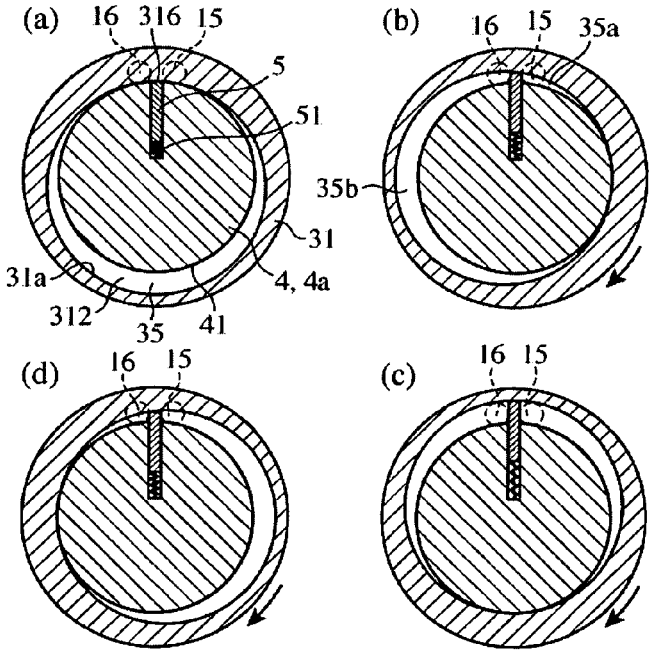
FIG. 20 is a cross-sectional view showing a principle of the increase or decrease in volume of the fluid chamber according to the third embodiment.

In another example of the machine, the number of the vanes 5 is one, and thus the number of components is smaller and the structure thereof is simpler. The inner circumferential surface 31*a* is comprised of a circle 31*a* and a slide contact line 316. The cam ring 31 and the rotor 32 constituting the rotor cam ring 3 are integrally formed. The fixed axis 4, the inlet cover 14 and the second flange 43 are also integrally formed. The rotor cam ring 3 shown in FIGS. 18 and 19 has the magnetic body ring 321 in the outer circumference into which a plurality of magnets 322 are embedded and has the cam ring 31 attached to the inner circumference such that the inner circumferential surface 31*a* is formed in the inner circumference and the rotor 32 is formed in the outer circumference. The fixed axis 4, the inlet cover 14 or the second flange 43 has a fixed axis portion 4*a* playing a role of the fixed axis 4, an inlet cover portion 14*a* playing a role of the inlet cover 14, a second flange portion 43*a* playing a role of the second flange 43 and a cam ring support base 14*b*. The cam ring support base 14*b* supports the rotation of the cam ring 31 and has a support surface 14*c* for supporting the outer circumferential surface of the cam ring 31. The first flange 12 fixed to the one end 11*a* of the casing body 11 has a storage portion 122 to which the first outlet 16 is opened. The outlet cover 13 joined to the first flange 12 has a second outlet 13*a*. An outlet valve 161 is attached to the outlet 16 of the first flange 12 on the side of the storage portion 122. A store room 17 is formed with the storage portion 122 and the outlet cover 13 joined to the first flange 12. The outlet valve 161 prevents the discharged fluid from flowing back into a fluid chamber 35 between the cam ring 31 and the fixed axis portion 4*a*. A plurality of holes 315 may be provided on the rotor cam ring 3 or on the cam ring 31 to minimize the vibration due to a centrifugal force. FIG. 20 shows a principle of the increase or decrease in volume of the fluid chamber 35 when the rotor cam ring 3 rotates. The circular cam ring 31 and the fixed axis portion 4*a* are coaxially arranged. The inner circumferential surface 31*a* is eccentrically arranged with respect to the cam ring 31. The inner circumference of the inner circumferential surface 31*a* and the outer circumference of the fixed axis portion 4*a* are circularly shaped with different diameters, and thus the inner circumferential surface 31*a* has slide contact with the outer circumferential surface 41 of the fixed axis portion 4*a* in a line (slide contact line 316). In FIG. 20(*a*), the vane 5 is in a position where the inner circumferential surface 31*a* has contact with the outer circumferential surface 41. The inlet 15 and the outlet 16 at both sides of the vane 5 do not communicate with the fluid chamber 35 between the inner circumferential surface 31*a* and the outer circumferential surface 41. When the cam ring 31 rotates clockwise from FIG. 20(*a*) to FIG. 20(*b*), the fluid chamber 35*a* expands to let in fluid into the fluid chamber 35*a* through the inlet 15 and the fluid chamber 35*b* diminishes to let out fluid from the fluid chamber 35*b* through the outlet 16. When the cam ring 31 reaches the state shown in FIG. 20(*c*), the fluid suction velocity and the fluid discharge velocity reach their maximum. When the cam ring 31 further rotates, the fluid suction velocity and the fluid discharge velocity decrease as shown in FIG. 20(*d*) and become zero when the cam ring 31 returns to the state shown in FIG. 20(*a*). As such, when the cam ring 31 makes one rotation, one cycle of fluid suction and fluid discharge is performed.

Figure 21:
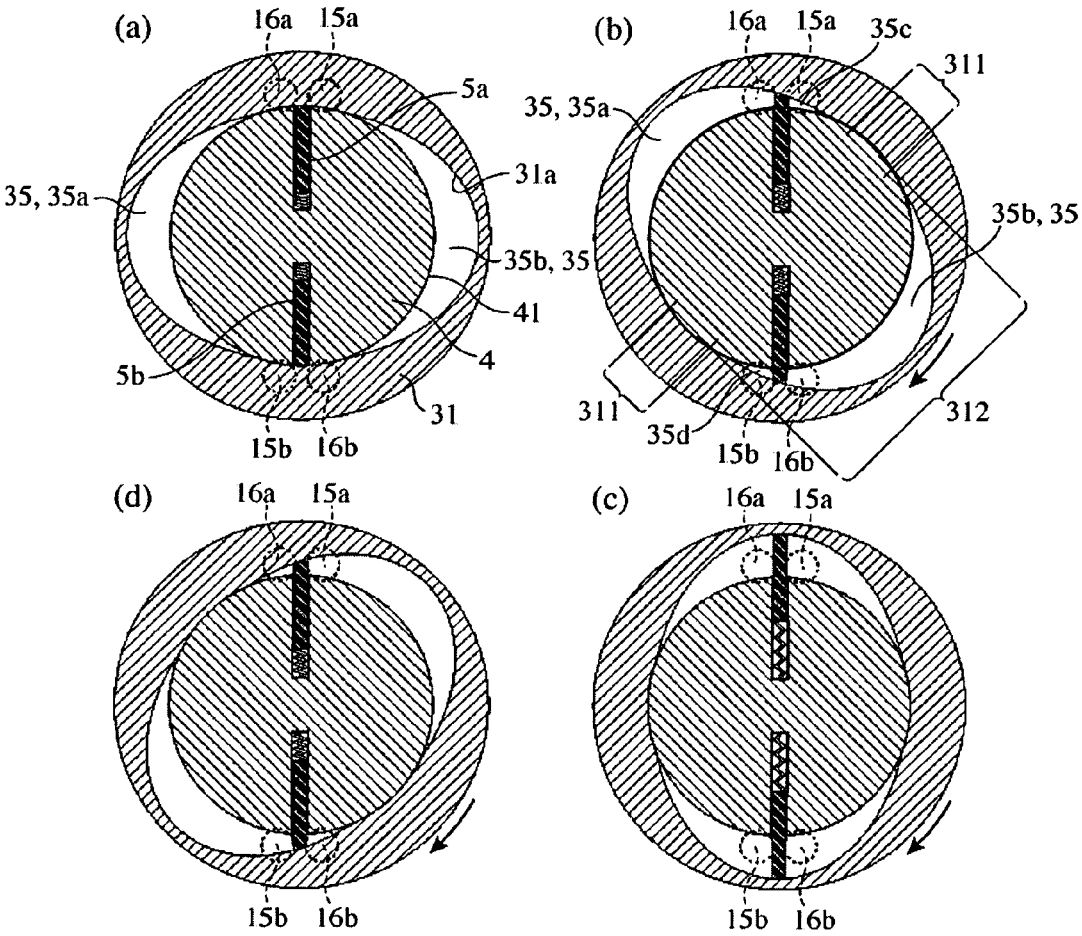
FIG. 21 is a cross-sectional view showing a principle of the increase or decrease in volume of the fluid chamber according to a fourth embodiment.

In another example, a cam ring 31 shown in FIG. 21 has an elliptical inner circumferential surface 31*a*. The number of arc-like recessed portions 312 is two and the number of vanes 5*a*, 5*b* is also two. When the number of vanes is two or more (that is, the same as the number of the arc-like recessed portions), the load applied to the fixed axis is reduced. The vibration of the machine due to the reciprocal motion of the vane is also reduced. When the vanes 5*a*, 5*b* are in positions as shown in FIG. 21(*a*) where the inner circumferential surface 31*a* has contact with the outer circumferential surface 41 of the fixed axis 4, the inlet 15*a*, 15*b* and the outlet 16*a*, 16*b* at both sides of the vanes 5*a*, 5*b* do not communicate with the fluid chambers 35*a*, 35*b* between the inner circumferential surface 31*a* and the outer circumferential surface 41. When the cam ring 31 rotates clockwise to a state shown in FIG. 21(*b*), the fluid chamber 35*c* expands to let in fluid through the inlet 15*a* and the fluid chamber 35*a* diminishes to let out fluid through the outlet 16*a*. The fluid chamber 35*d* expands to let in fluid through the inlet 15*b* and the fluid chamber 35*b* diminishes to let out fluid through the outlet 16*b*. When the cam ring 31 reaches the state shown in FIG. 21(*c*), the fluid suction velocity through the inlet 15*a*, 15*b* and the fluid discharge velocity through the outlets 16*a*, 16*b* become maximum respectively. When the cam ring 31 further rotates, the cam ring 31 returns to the state of FIG. 21(*a*) through the state of FIG. 21(*d*). As such, when the cam ring 31 rotates, fluid is let in and let out in the same phase.

Figure 23:
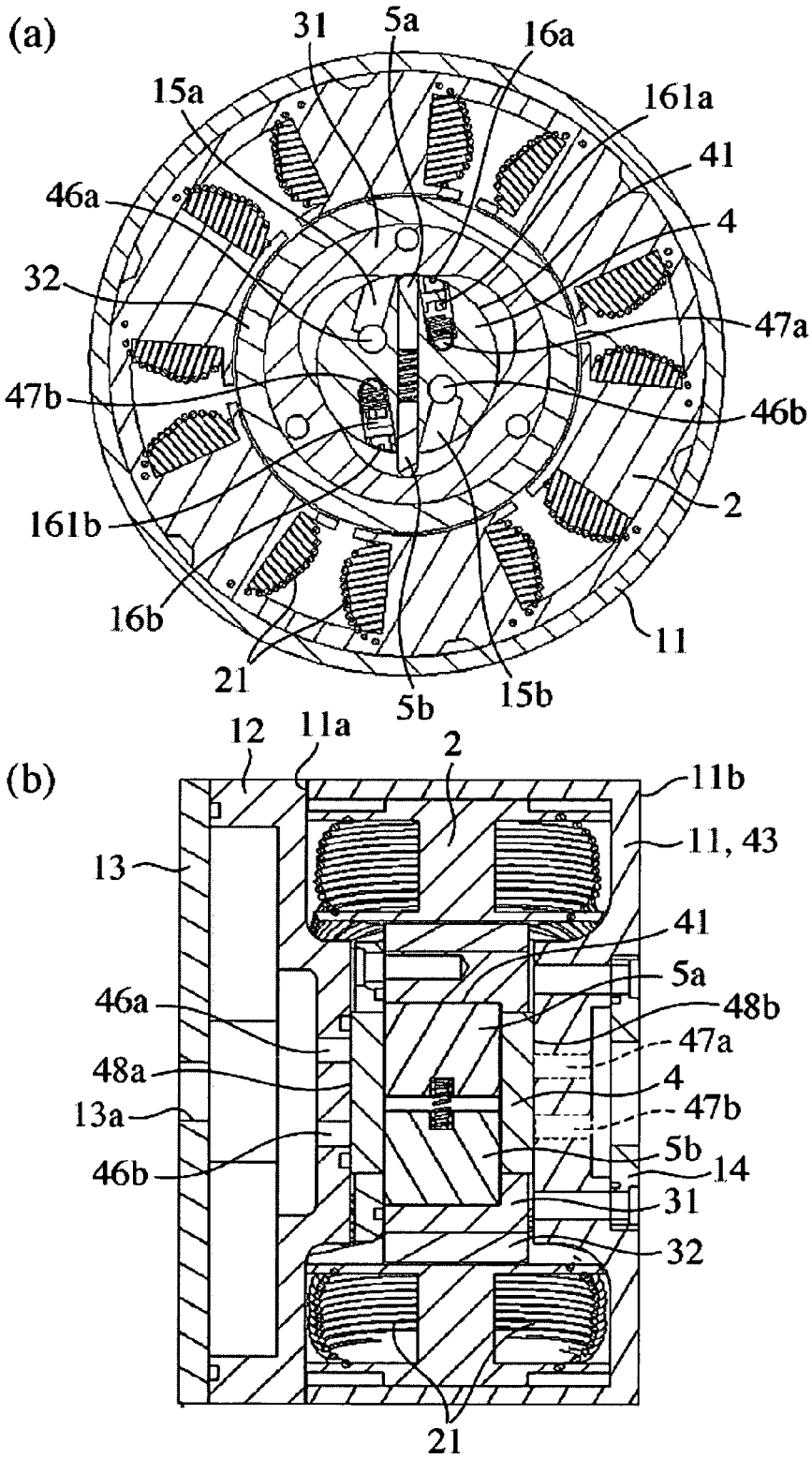
FIG. 23 shows a machine according to the fifth embodiment.

Another example with a fixed axis 4 shown in FIG. 22 has inlets 15*a*, 15*b* and outlets 16*a*, 16*b* opened to the outer circumferential surface 41 on both sides of the vane grooves 42*a*, 42*b*. The vane grooves 42*a*, 42*b* accommodate vanes 5*a*, 5*b*. One end 48*a* of the fixed axis 4 is joined to the first flange 12, and the other end 48*b* is joined to the second flange 43. The second flange 43 and the casing body 11 are integrally formed as shown in FIG. 23. The inlet holes 46*a*, 46*b* extend in the fixed axis 4 and communicate with the inlets 15*a*, 15*b*. The outlet holes 47*a*, 47*b* extend in the fixed axis 4 and communicate with the outlets 16*a*, 16*b*. The outlets 16*a*, 16*b* and the inlets 15*a*, 15*b* need to be placed right next to the vane grooves 42*a*, 42*b* and thus preferably tilt toward the vane grooves 42*a*, 42*b* in order to improve the workability. Outlet valves 161*a*, 161*b* are provided on the outlets 16*a*, 16*b*.

Figure 24:
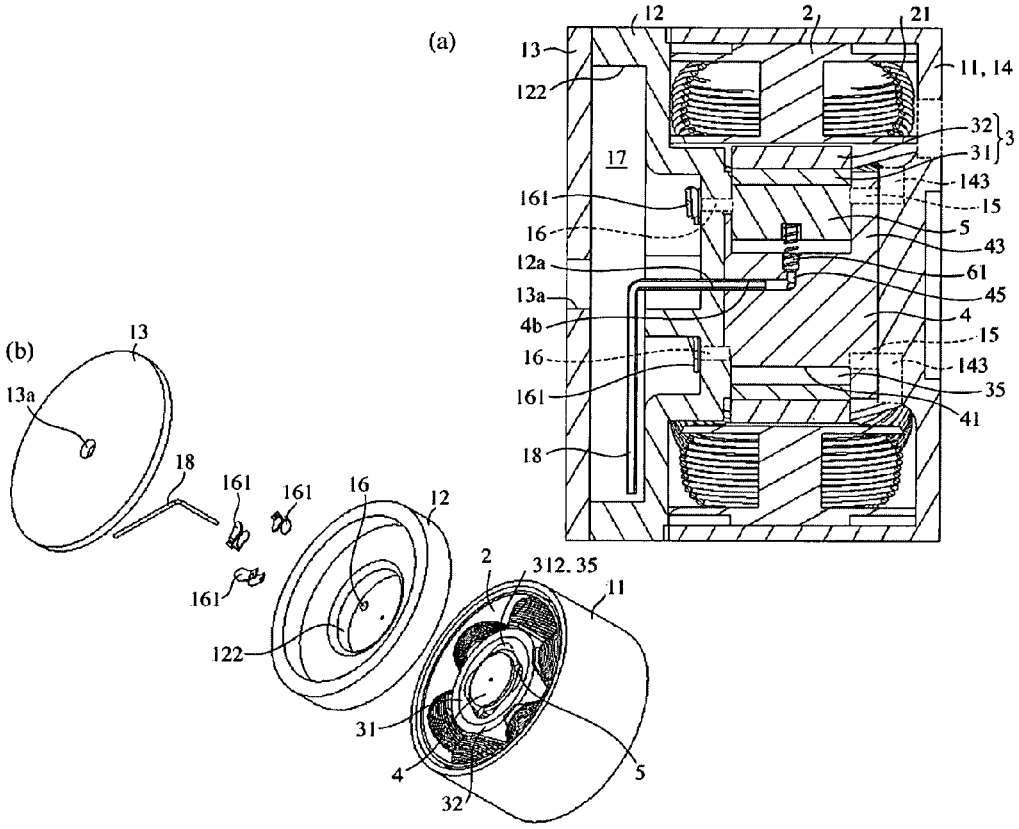
FIG. 24 shows a compressor according to a sixth embodiment.

An example compressor shown in FIG. 24 has an oil supply tube 18 and an outlet valve 161. An oil supply hole 12*a* of the first flange 12 and an oil supply hole 4*b* of the fixed axis 4 communicate with a through-hole 45 in the bottom portion of the vane groove 42. The oil supply tube 18 inserted into the oil supply hole 12*a* and the oil supply hole 4*b* extends up to the lower portion of the storeroom 17. The oil stored in the lower portion in the storeroom 17 is supplied to the vane groove 42 through the oil supply tube 18, the through-hole 45 and the spring hole 61. The oil supply tube 18 serves not only to supply oil but also to apply a back pressure to the vane 5 with the pressure of the vane groove 42 being substantially the same as the pressure of the outlet 16. Three outlet valves 161 are placed at the three outlets 16 of the first flange 12 such that the fluid discharged from the outlet 16 is prevented from flowing back to the side of the outlet 16. The casing body 11 and the inlet cover 14 are integrally formed. Gas and oil flowing from the three inlets 13 provided on the second flange 43 which is integrally formed with the fixed axis 4, pass through the fluid chamber 35, and the gas is compressed, and flowed into the storeroom 17 together with the oil through the three outlets 16. The compressed gas goes out from the storeroom 17 and is discharged from the outlet 13*a*. The oil is supplied to the vane groove 42 through the oil supply tube 18 after being stored in the storeroom 17.

Figure 25:
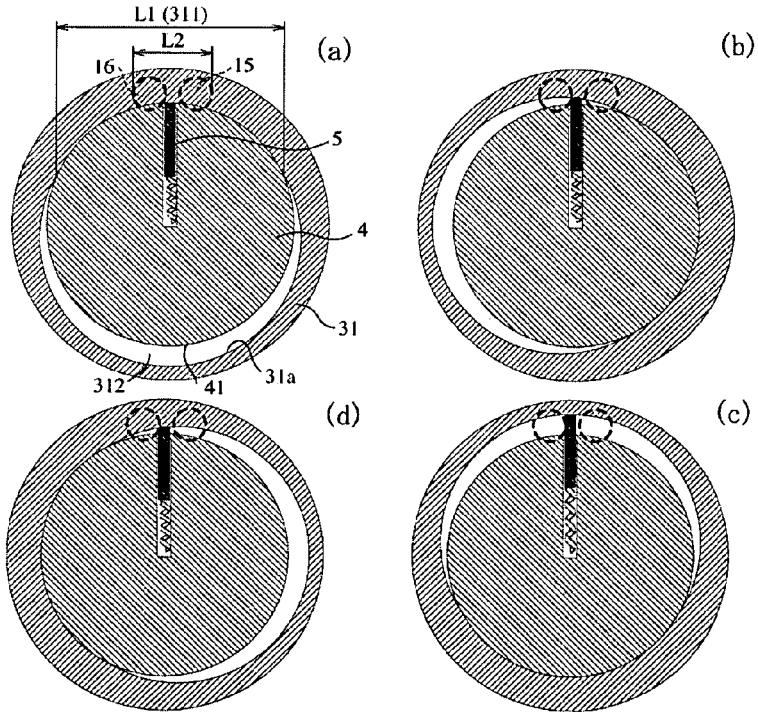
FIG. 25 is a cross-sectional view showing a principle of the increase or decrease in volume of the fluid chamber according to a seventh embodiment.

In another example shown in FIG. 25, the number of arc-like recessed portions 312 of the cam ring 31 is one and the number of vanes 5 is also one. The inner circumferential surface 31*a* of the cam ring 31 has contact with the outer circumferential surface 41 of the fixed axis 4 in a plane (slide contact surface 311). When the center of the slide contact surface 311 is located near the vane 5, the length L1 of the slide contact surface 311 is longer than the length L2 between the outlet 16 and the inlet 15 such that the high-pressure fluid on the side of the outlet 16 does not flow back to the low-pressure fluid on the side of the inlet 15 through the arc-like recessed portion 312.

Figure 26:
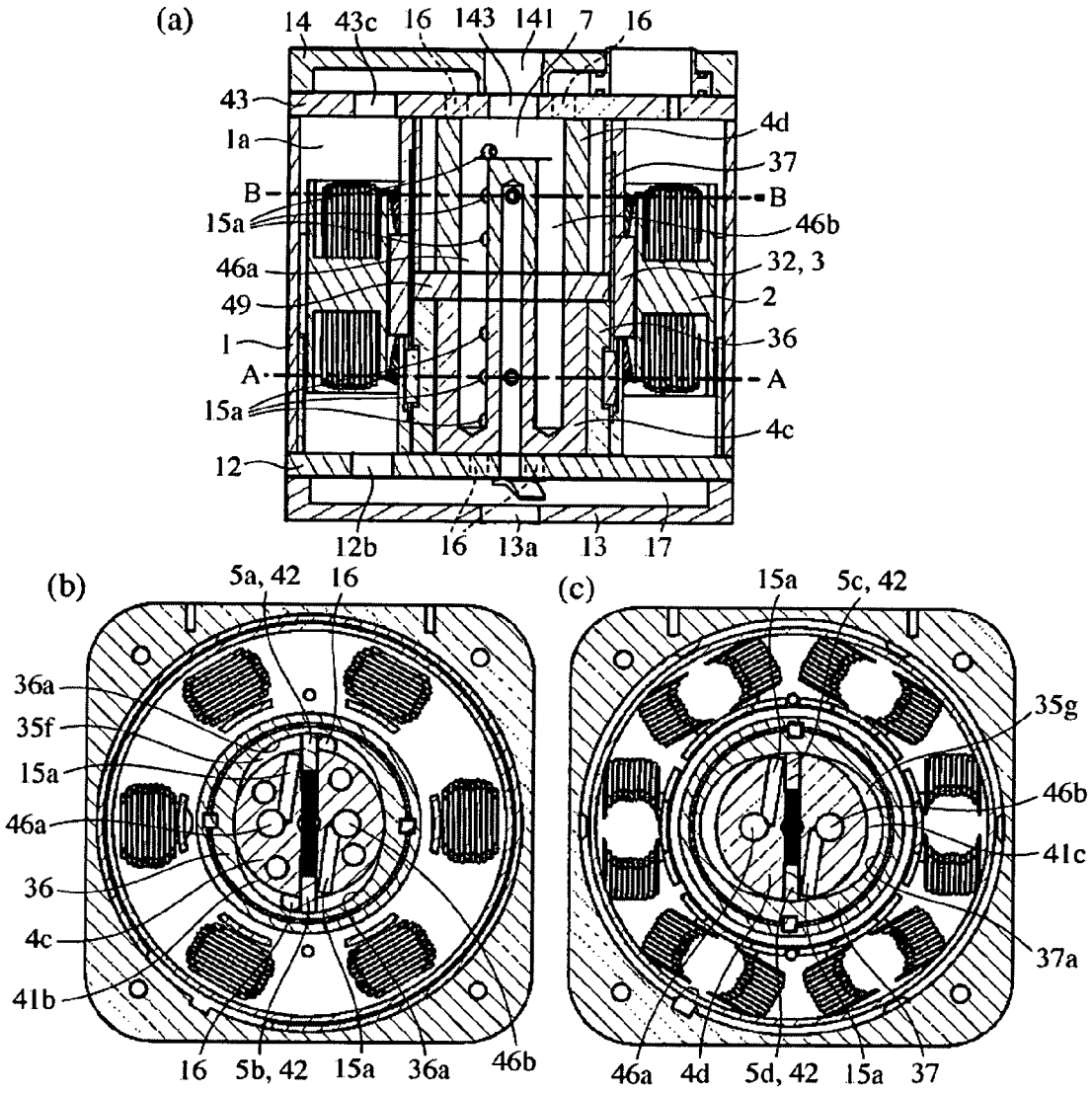
FIG. 26 shows a machine according to an eighth embodiment.

Another example of a machine shown in FIG. 26 is provided with two sets of the fixed axis 4, the cam ring 31 and the vanes 5*a*, 5*b* shown in FIG. 21 in an axial direction, and two cam rings 36, 37 are shifted 90° from each other, and thus pulsatory motion and torque fluctuation are minimized. Further, the empty space such as the space 1*a* in the casing 1 between the first flange 12 and the second flange 43 in which no components exist plays a role of the storeroom 17, and thus a large volume storeroom can be secured. The rotor cam ring 3 has the inner circumferential surface 36*a* of the first cam ring 36 and the inner circumferential surface 37*a* of the second cam ring 37 on the inner circumference thereof, and a rotor 32 on the outer circumference thereof. A first fixed axis 4*c* has two vane grooves 42 inside the rotor cam ring 3, and has the first flange 12 and the third flange 49 on both sides. A second fixed axis 4*d* has two vane grooves 42 inside the rotor cam ring 3, and has the second flange 43 and the third flange 49 on both sides. Both the first fixed axis 4*c* and the second fixed axis 4*d* have two vanes 5 respectively. Four vane grooves for accommodating the vane 5 are positioned in the same axial line. A first fluid chamber 35*f* is formed with the inner circumferential surface 36*a* of the first cam ring 36, the outer circumferential surface 41*b* of the first fixed axis 4*c*, vanes 5*a*, 5*b*, the first flange 12, and the third flange 49. A second fluid chamber 35*g* is formed with the inner circumferential surface 37*a* of the second cam ring 37, the outer circumferential surface 41*c* of the second fixed axis 4*d*, vanes 5*c*, 5*d*, the second flange 43, and the third flange 49. When the rotor cam ring 3 rotates, the volume of the first fluid chamber 35*f* and the second fluid chamber 35*g* increases or decreases.

The first fixed axis 4*c* and the second fixed axis 4*d* have two sets of three inlets 15*a* each. The first flange 12 and the second flange 43 have two outlets 16 respectively. Fluid enters through the inlet 141 of the inlet cover 14 and flows into a communication groove 7 of the second fixed axis 4*d* through an intermediate inlet 143 of the second flange 43. One part of the fluid in the communication groove 7 communicates with the inlet hole 46*a* of the second fixed axis 4*d*, the inlet hole 46*a* of the third flange 49, and the inlet hole 46*a* of the first flange 12. The other part of the fluid communicates with the inlet hole 46*b* of the second fixed axis 4*d*, the inlet hole 46*b* of the third flange 49, and the inlet hole 46*b* of the first flange 12. The fluid that has entered into the inlet holes 46*a*, 46*b* of the second fixed axis 4*d* flows in the second fluid chamber 35*g* through the six inlets 15*a* of the second fixed axis 4*d*. The fluid that has entered into the inlet holes 46*a*, 46*b* of the first fixed axis 4*c* flows in the first fluid chamber 35*f* through the six inlets 15*a* of the first fixed axis 4*c*. The fluid in the fluid chambers 35*f*, 35*g* pass through the outlet hole 12*b* of the first flange 12 and the outlet hole 43*c* of the second flange 43 from the total four outlets 16, join together and are discharged from the outlet 13*a* of the outlet cover 13.

Figure 27:
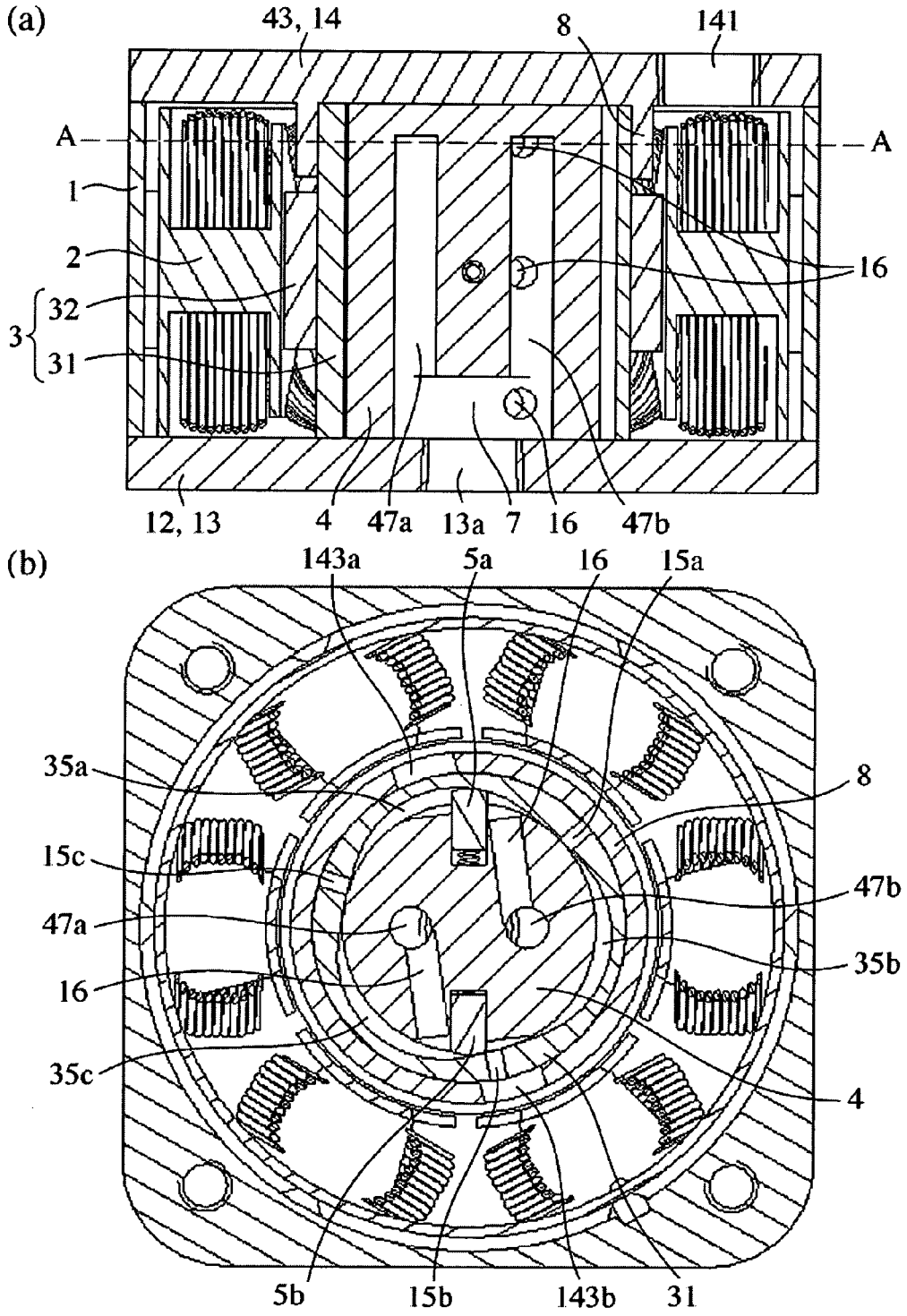
FIG. 27 shows an expander according to a ninth embodiment.

In another example an expander integrally formed with a generator shown in FIG. 27 has three inlets 15*a*, 15*b*, 15*c* in the rotor cam ring 3 or the cam ring 31. The first flange 12 and the outlet cover 13 are integrally formed. The second flange 43 and the inlet cover 14 are integrally formed, and an inlet drum 8 is provided so as to have contact with the outer circumferential surface of the cam ring 31. High-pressure fluid is sucked through the inlet 141 of the inlet cover 14, and is expanded in the three fluid chambers 35*a*, 35*b*, 35*c* after being sucked so as to pass through an intermediate inlet 143*a* or 143*b* arranged in the inlet drum 8 that is integrally provided with the second flange 43 and through the inlet 15*a*, 15*b* or 15*c* of the cam ring 31, thereby rotating the rotor cam ring 3 and generating power while the high-pressure fluid changing to low-pressure fluid. The fluid that was changed into the low-pressure fluid in the fluid chambers 35*a*, 35*b*, 35*c* passes through the six outlets 16 of the fixed axis 4, two outlet holes 47*a*, 47*b* and the communication groove 7 and is discharged from the outlet 13*a* of the outlet cover 13.

While the invention has been described with reference to a limited number of embodiments, those skilled in the art having the benefit of this disclosure will readily devise other embodiments which do not depart from the scope of the invention as herein described. Accordingly, the invention shall be limited in scope only by the attached claims.

The invention claimed is:

1. A rotary cam ring fluid machine comprising:

(a) a casing; (b) a flange which is fixed to the casing; (c) a stator which is arranged in the casing; (d) a rotor cam ring which is arranged in the stator and has an inner circumferential surface on the inner circumference thereof and a rotor on the outer circumference thereof; (e) a fixed axis which has a vane groove opened to the outer circumferential surface thereof inside the rotor cam ring and has the flange at the end surface thereof; and (f) a vane which is accommodated in the vane groove of the fixed axis, wherein:

(g) a fluid chamber is formed with the inner circumferential surface of the rotor cam ring, the outer circumferential surface of the fixed axis, the vane and the flange, and (h) when the rotor cam ring rotates, the volume of the fluid chamber increases or decreases.

2. The rotary cam ring fluid machine according to claim 1, wherein:

an inlet or an outlet is arranged on the fixed axis, the flange or the rotor cam ring.

3. The rotary cam ring fluid machine according to claim 1, wherein:

the inner circumferential surface of the rotor cam ring has a circular or arc-like recessed portion and a line or a surface which has slide contact with the outer circumferential surface of the fixed axis.

4. The rotary cam ring fluid machine according to claim 1, wherein:

the number of the vanes is smaller by one than the number of the arc-like recessed portions.

5. The rotary cam ring fluid machine according to claim 1, wherein:

the vain has a groove which can be a back pressure groove.

6. The rotary cam ring fluid machine according to claim 1, wherein:

the vane groove has a hole which can be a spring hole or through-hole in the bottom portion.

7. The rotary cam ring fluid machine according to claim 1, wherein:

the slide and contact surface has a tip seal groove in the center thereof and the tip seal groove is tilted with respect to the axial direction.

8. The rotary cam ring fluid machine according to claim 1, wherein:

the end surface of the rotor cam ring has slide contact with the flange through a ring seal under hermetically sealed condition.

9. The rotary cam ring fluid machine according to claim 1, wherein:

the end surface of the rotor cam ring or the flange has a ring seal groove, and the ring seal groove is eccentrically arranged with respect to the axis center of the rotor cam ring.

* * * * *